United States Patent [19]

Foley, Jr.

[11] Patent Number: 4,549,369

[45] Date of Patent: Oct. 29, 1985

[54] DRIVE-ACTUATED LATCHING DEVICE FOR A SECURITY PARKING GATE

[75] Inventor: Daniel M. Foley, Jr., Los Angeles, Calif.

[73] Assignee: Fred Brail, Inglewood, Calif. ; a part interest

[21] Appl. No.: 557,428

[22] Filed: Dec. 2, 1983

[51] Int. Cl.[4] ..... E05F 15/00

[52] U.S. Cl. ..... 49/279; 49/280; 292/144; 292/168

[58] Field of Search ..... 49/280, 279; 292/174, 292/171, 168, 144, DIG. 39, DIG. 40

[56] References Cited

U.S. PATENT DOCUMENTS

| | | | |
|---|---|---|---|
| 3,435,558 | 4/1969 | Kruse | 49/280 X |
| 3,526,994 | 9/1970 | Delaney | 49/280 X |
| 3,606,699 | 9/1971 | Robinson, Jr. | 49/280 |
| 4,080,757 | 3/1978 | Westerman | 292/171 X |
| 4,313,281 | 2/1982 | Richmond | 49/280 |

*Primary Examiner*—Philip C. Kannan

*Attorney, Agent, or Firm*—Henry M. Bissell

[57] ABSTRACT

A latching device for a security gate of the type used at the entrance of subterranean garages for apartments or condominiums or secured storage rental areas is disclosed which is mechanically actuated by operation of the motor drive system to open the security gate. The latching device effectively prevents the security gate from being forced open, and in one embodiment includes a mechanism for preventing manual disengagement of the latch from attempts to force the gate laterally until the latch disengages. The latching device of the present invention is substantially cheaper than other security gate locking devices, as well as being highly reliable and wear-resistant.

27 Claims, 6 Drawing Figures

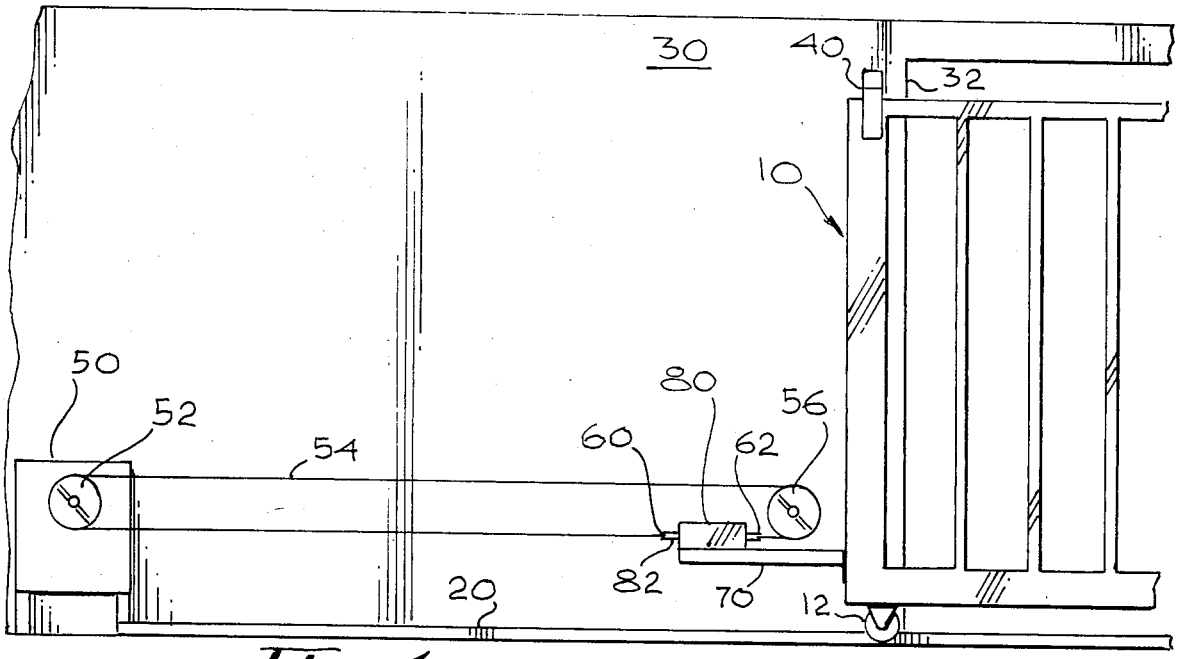
Fig. 1
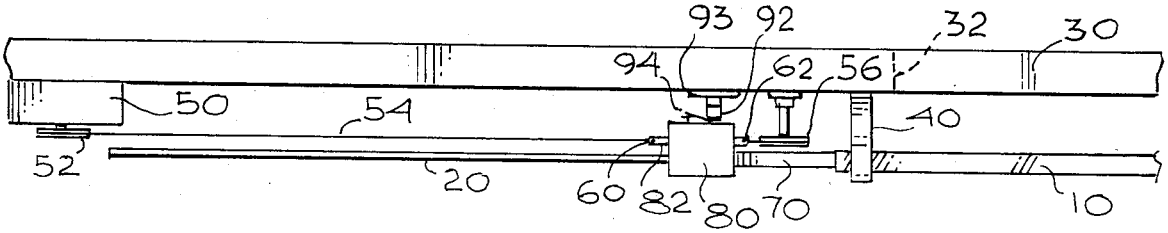
Fig. 3
Fig. 2
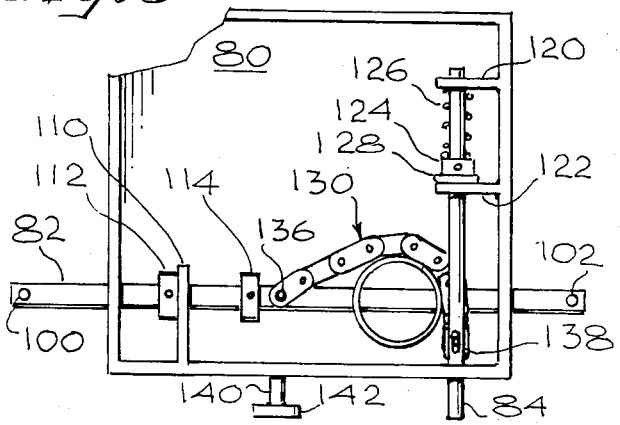
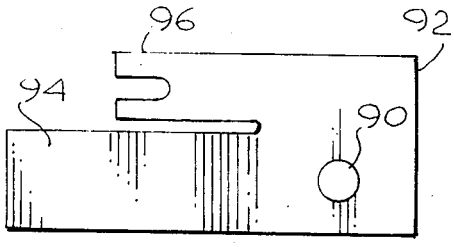
Fig. 4
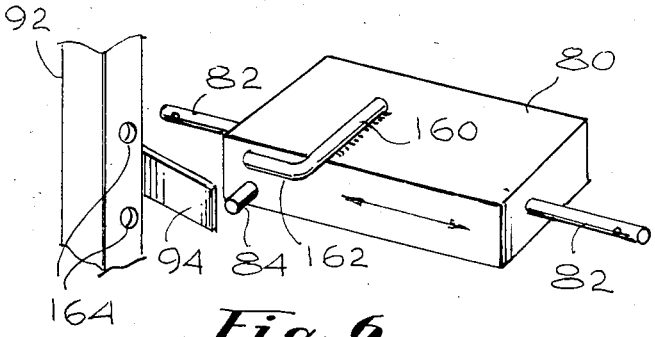
Fig. 6
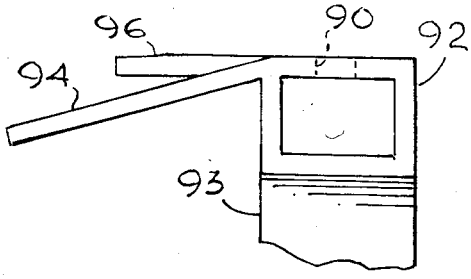
Fig. 5

DRIVE-ACTUATED LATCHING DEVICE FOR A SECURITY PARKING GATE

BACKGROUND OF THE INVENTION

1. Field of the Invention

This invention relates to security systems and, more particularly, to latching arrangements for power driven gates used in secured areas.

2. Description of the Prior Art

The use of security gates has been steadily increasing in applications such as subterranean garages for apartments or condominiums and as a means for controlling access into secured storage rental areas, since the use of such gates is substantially cheaper than the cost of hiring a security guard for round-the-clock protection against theft and vandalism. Such security gates are sturdily constructed of heavy iron or steel bars, and are driven on metal tracks by an electric drive system actuated by either a remote control unit or by a stationary electric input unit, such as a keyed switch or a key pad into which a predetermined code must be entered to gain access. By requiring either possession of an appropriately-coded remote control unit, a key or knowledge of an entry code, access to the garage or rental areas may be limited to minimize the possibility of unauthorized entry, theft, or vandalism.

The security gate is typically driven by a chain drive extending between a gear-reduction electric motor drive and the gate, typically with one or more idler wheels mounted on a fixed portion of the wall or fence adjacent the security gate. While such security systems operate efficiently and cheaply and are effective in limiting unauthorized entry to the secured area, they offer a barrier which may usually be circumvented in seconds by a professional criminal. By placing a sufficient amount of pressure on most closed security gates, the gate will either yield with moderate difficulty, or resist until the weakest component in the system, usually the chain used to drive the gate, fails by snapping, thus allowing the gate to slide smoothly open.

In order to prevent security gates from being forced open, some type of mechanical latching device which securely latches when the gate is closed, and which will only unlatch when the unlocking signal is received by the system is required. Such a latching system must be highly resistant to attempts to force the security gate open. The latching device must also open quickly and smoothly, and minimize the amount of failures requiring trained repair personnel to correct.

One such device is an electromagnetic solenoid-driven bolt device, which is mounted on a portion of the security gate inaccessible from outside the secured area. The bolt is provided with a reinforced metal aperture into which to slide, the aperture being mounted on the wall or floor of the secured location. When the electromagnetic solenoid is deactivated, the bolt automatically moves into the aperture, completely preventing movement of the gate until the solenoid is activated again.

Although the electromagnetically-driven solenoid-actuated bolt latching device works quite well on initial installation, it has a number of significant problems. The first problem is that wear, damage from use, or a poor fit from a faulty installation may result in failure of the bolt to be driven electromagnetically out of the aperture upon activation of the solenoid. Since it is quickly recognized that such solenoids may provide only a limited amount of force, there is a persistent problem in such devices presented by the bolts sticking in the aperture due to one of the aforesaid reasons, preventing the security gate from being opened when desired.

A second problem with the electromagnetically-driven solenoid-actuated latch is that, since the device is driven by electricity, there must necessarily be an electrical link between the solenoid assembly mounted on the gate and the fixed components of the system mounted within the secured area. Such an electrical link is difficult to arrange in an economical installation, and is also subject to a substantially higher than acceptable failure rate. A major disadvantage of the electromagnetic solenoid latching device is the simple fact that such a system is quite expensive to manufacture and to install, particularly if the system is to be constructed to minimize the above-described mechanical disadvantages. The high cost of purchase and installation effectively prevents installation of a latching system on security gates in all but the largest apartment or condominium complexes, or storage rental areas. It can thus be appreciated that there is a substantial need for a reliable, simple latching device to control access to areas protected by a security gate.

SUMMARY OF THE INVENTION

The present invention is a mechanical latching device mounted on a portion of the security gate remaining inside the secured location, which prevents movement of the security gate unless the drive system is first actuated, indicating desired entry by an authorized person. The latching device operates by incorporating a sliding bolt or pin which, when locked, fits into an aperture in a member mounted in a stationary manner within the secured area. When the pin is located in the aperture, the gate may not be opened, even by application of a considerable amount of force by an experienced criminal.

Movement of the pin out of the aperture mounted in the stationary member is caused to occur when the drive system is actuated. Actuation of the drive system to open the security gate mechanically causes the pin to be moved outward and free of the aperture, allowing the security gate to be opened by the further movement of the drive system. In this manner, it can be seen that since the only way of unlatching the device to allow the security gate to open is by actuating the motorized drive system, unauthorized entry to be secured area by application of force on the security gate simply cannot occur. In effect, the weakest link in the system is now mechanically actuated bolt instead of the chain or the electrically actuated solenoid of prior art systems, and the bolt is sized sufficiently large enough to prevent unauthorized entry by the application of force on the security gate.

In accordance with an additional aspect of the present invention, a second pin disposed on the outside of the housing containing the latching device has at its end a fixedly mounted collar. When the security gate closes, this second pin is inserted through a fork mounted on the stationary member containing the aperture, with the collar being located below the fork. By the use of the second pin, the locking pin may not be removed from the aperture by pushing or pulling the gate laterally to dislodge the latch pin from its latched position and the system is made fully secure, requiring the virtual destruction of the gate in order to obtain unauthorized entry.

In an alternative arrangement to the second pin, and angled rod is affixed to the outside of the housing for engaging an opening in one side of the stationary member as the gate moves to the closed and latched position. With the rod thus engaging this opening, lateral movement of the gate and latching device to permit the bolt to move out of engagement in the stationary member aperture cannot occur.

Since the latching device of the present invention is mechanically actuated by the motorized chain drive, it remains a substantially cheaper and more dependable system than is the electromagnetically operated solenoid latching device. Due to the simple mechanical construction of the present invention, it is also cheaper and easier to install on an existing security gate, and it is not subject to the high failure rate of pre-existing solenoid-type devices.

Therefore, the latching device which is the subject of the present invention provides an economical and effective, easily installed system developing a high degree of security to gates for parking areas in condominiums or apartments, as well as security gates in storage rental areas. The present invention achieves these important advantages with virtually no drawbacks, and will provide years of virtually maintenance-free operation in such applications.

DESCRIPTION OF THE DRAWINGS

These and other advantages of the present invention are best understood through reference to the accompanying drawings, in which:

FIG. 1 shows a front view of the latching device of the present invention installed on a security gate in the interior of the secured area;

FIG. 2 shows a top view of the installation of the present invention shown in FIG. 1;

FIG. 3 shows from the underside a detailed view of the operating mechanism contained within a housing mounted as described in FIGS. 1 and 2;

FIG. 4 shows an elevation view of the stationary member of the latching system of the present invention;

FIG. 5 shows a view from the underside of the stationary member of the present invention shown in FIG. 4; and FIG. 6 is a perspective view showing details of an alternative protective arrangement to that which is particularly shown in FIG. 4.

DETAILED DESCRIPTION OF THE PREFERRED EMBODIMENT

A standard configuration security gate and operating system therefor utilizing the present invention is shown in FIGS. 1 and 2 with a security gate 10 slidably mounted by use of wheels 12 on a track 20 mounted within the interior of the area to be secured adjacent a wall 30. Note that with the gate 10 in the closed position shown in FIGS. 1 and 2, the leftmost edge of the gate 10 is to the left of the opening 32 in the exterior wall 30. A guiding arm 40 fixedly mounted on the wall 30 guides the upper portion of the gate 10 as it slides back and forth.

Relative movement of the security gate 10 along the track 20 is caused by operation of a motorized drive 50 which rotates a drive sprocket 52. The drive sprocket 52 drives a drive chain 54 travelling around an idler sprocket 56 rotatably mounted to the wall 30 or a support adjacent thereto.

In an installation not including the present device, the two ends 60 and 62 of the drive chain 54 would be connected directly to a latch bar 70 which is fixedly attached by welding or other means to the side of the security gate 10. By operation of the motorized drive 52 to actuate the drive chain 50, the security gate 10 is thusly caused to open and close.

Referring to FIGS. 1 and 2, the latching mechanism of the present invention is contained within a housing 80 mounted on the latch support bar 70, and the ends 60 and 62 of the drive chain 54 are attached to a control bar 82 extending through the housing 80 of the latch mechanism. For implementing the invention it should be noted that only the rod 60 need be secured to the control bar 82, and that the other end 62 could be secured to the housing 80. It will be appreciated that the latch mechanism includes a locking pin 84 (not shown in FIG. 1 or 2) which may be slidably inserted into an aperture 90 (not shown in FIG. 1 or 2) contained in a stationary locking member 92, which is mounted in a stationary manner by a bracket 93 to the wall 30. The stationary locking member 92 also includes a ramp 94 and a fork 96 (not shown in FIG. 1 or 2), the purposes and operation of which will be apparent in the descriptions accompanying the additional figures below.

The characteristics of the latching operation of the present invention may be explained with reference to FIG. 1. When the motorized drive 50 drives the drive chain 54 through the drive sprocket 52 to open the security gate 10, one end 60 of the drive chain 54 will exert a leftward pull on the control bar 82 extending through the housing 80. When the control bar 82 moves leftwardly a sufficient distance within the housing 80, it causes the locking pin 84 (not shown in FIG. 1) to disengage from the stationary locking member 92. The security gate 10 is then drawn by the drive chain 54 into a fully open position.

After a predetermined period of time as is standard in the industry, the motorized drive 50 will drive the drive chain 54 in the opposite direction, with the other end 62 of the drive chain 54 pulling on the right end of the control bar 82 to drive the security gate 10 into the fully closed position shown in FIG. 1. The locking pin 84 (not shown in FIG. 1) will travel up the ramp 94 and into the aperture 90 (not shown in FIG. 1) in the stationary locking member 92, thus locking the security gate 10 in the fully closed position.

Referring now to FIG. 3, the latching mechanism inside the housing 80 is shown in detail. The control bar 82 is slidably mounted within the housing 80 and has a hole 100 in the left end thereof, and a second hole 102 in the right end thereof. One end 60 of the drive chain 54 (FIG. 1) is connected to the left end of the control rod 82 by a pin (not shown) through the hole 100, and the other end 62 of the drive chain 54 is connected to the right end of the control bar by a second pin (not shown) through the second hole 102.

Disposed within the housing 82 is a reinforced rib 110 through which the control bar 82 movably extends. Mounted on the control bar 82 within the housing and on the left side of the reinforced rib 110 is a left collar 112 which limits the rightward movement of the control bar 82. Fixedly mounted on the control bar 82 within the housing 80 and on the right side of the reinforced rib 110 is a right collar 14. The left collar 112 and the right collar 114, in conjunction with the reinforced rib 110, limit axial movement of the control bar 82 to a short distance, for example one or two inches.

Also mounted in the housing 80 is the locking pin 84, which moves axially into and out of the housing 80 as guided by a first guide rib 120 and a second guide rib 122. Movement of the locking pin 84 out of the housing 80 is limited by a restraining collar 124 mounted on the locking pin 84 and between the first guide rib 120 and the second guide rib 122. Also mounted on the locking pin 84 between the first guide rib 120 and the retaining collar 124, and exerting a force therebetween, is a drive spring 126, which urges the locking pin 84 into its locking position, in which it is extending out of the housing 80. Disposed between the retaining collar 124 and the second guide rib 122 may be a cushioning washer 128, preferably made of rubber or plastic.

The latching mechanism is operated by axial movement of the control bar 82 acting to draw the locking pin 84 into the housing 80 by means of a flexible link 130 connected between the control bar 82 and the locking pin 84, and acting around a circular support structure 134. It may be seen in FIG. 3 that the control bar 82 extends through the circular support structure 134, which is located within the housing 80 and adjacent the locking pin 84, which is oriented orthogonally from the control bar 82. The flexible link 130 is attached to the control bar 82 by a pin 136, and to the locking pin 84 by a pin 138. The circular support structure 134 is fixedly connected to the interior of the housing 80, and is circular in its outer configuration to allow the flexible link 130 to extend around an outer portion of the circular support structure 134, and thus transpose movement from one axis to a second orthogonal axis.

The flexible link 130 has a predetermined length which draws the control bar 82 to its rightward limit (as determined by the positon of the left collar 112 and the reinforced rib 110) while simultaneously allowing the locking pin 84 to extend fully out of the housing 80 as it is biased by the drive spring 126. Although the flexible link 130 is illustrated to be a multi-link chain, it could be made of any flexible and sturdy material, such as a heavy flexible steel cable. Similarly, the circular support structure 134 shown in FIG. 3 is merely a piece of pipe welded into the interior of the housing 80, which has been found to be more economical than the use of pulleys or other support structure of the same configuration.

In can therefore be seen from FIG. 3 that when the control bar 82 is drawn leftwardly relative to the housing, it will tend to draw the flexible link 130 with it, retracting the locking pin 84 into the housing. It is noteworthy that the position of the right collar 114 on the contol bar 82 must be set to prevent damage from occurring to the drive spring 126; therefore, the right collar 114 is set so that it is adjacent the reinforced rib 110 at the point where the locking pin 84 is fully retracted into the housing 80.

The stationary locking member 92 is best illustrated in FIGS. 4 and 5. It can be seen that the stationary locking member 92 has an aperture 90 therein, which is designed for receiving the locking pin 84 (shown in FIG. 3). Also connected to the stationary locking member 92 is a ramp 94, as well as a fork 96. Referring generally to all of the figures, it can be seen that when the gate is in the fully closed position, the locking pin 84 will extend into the aperture 90 in the stationary locking member 92. When the motorized drive 50 is actuated to open the security gate 10, the chain 54 will draw the control bar 82 leftwardly within the housing 80. The leftward movement of the control bar 82 will cause a translational movement of the locking pin 84 whereby the locking pin 84 withdraws into the housing 80, freeing the security gate 10 to open. The drive chain 54 then draws the gate 10 to a fully open position.

After the predetermined delay interval, the motorized drive 50 will drive the drive chain 54 to close the security gate 10. As the gate and the latching device approach the latching position, the locking pin 84 will be extended from the housing 80, since the drive chain 54 is pulling the control bar 82 rightwardly. As the locking pin 84 approaches the stationary locking member 92, it will be forced inwardly into the housing 80 by the ramp 94. As the gate 10 reaches its fully closed position, the locking pin 84 will drop off the ramp and extend into the aperture 90 in the stationary locking member 92, propelled out of the housing 80 by the drive spring 126.

An additional refinement contained by the latching mechanism of the present invention is designed to prevent unauthorized entrance being made by forcing the gate 10 away from the stationary member 94 and thereby withdrawing the locking pin 84 out of the aperture 90, thus allowing the gate 10 to be forced open. Attached to the back of the housing 80 is a pin 140 containing a collar 142 fixedly mounted to the end of the pin 140. As the gate closes, the pin 140 will move into the slot in the fork 96 (FIG. 4) with the collar 142 located behind the fork 96. In this manner, the housing 80 is restrained by the pin 140, the collar 142, and the fork 96 from being moved laterally a sufficient amount to remove the locking pin 84 from the aperture 90.

FIG. 6 shows an alternative embodiment of the invention. The arrangement of FIG. 6 is essentially the same as that depicted particularly in FIGS. 3, 4 and 5, with the exception of the fork 96 and pin 140 with its collar member 142. Instead of these keeper elements, the housing 80 is provided with an angled rod 160 which is welded, or secured by other suitable means, to the upper surface of the housing 80 so that the angled end portion 162 extends beyond the edge of the housing 80. In this arrangement, the stationary member 92 is provided with a pair of openings 164 above and below the ramp 94 and situated so that one opening receives the angled portion 162 of the rod 160 as the housing 80 moves into position for the bolt 84 to engage the mating aperture 90 (FIG. 4) in the member 92. In the arrangement depicted in FIG. 6, the angled end portion 162 slides into the upper opening 164 and, as long as the angled end portion 162 is engaged within the opening 164, the gate and housing 80 cannot be forced laterally away from the member 92 by a distance sufficient to release the bolt 84 from the aperture 90. The lower opening 164 is provided as a symmetrical arrangement for engaging the angled end portion 162 of the rod 160 for installation on a gate which is closed by moving in the opposite direction; that is, from the left side as viewed in FIG. 6. All components would be reversed with the member 92 being inverted from the configuration shown in FIG. 6 for such a left-hand opening gate.

It can therefore be seen that the disclosed embodiment of the present invention is a secure latching device for a security gate, which may be actuated by the motorized drive system of the security gate system. Thus the latching device of the invention provides a non-electrical means of locking an electrically operated, chain-loop-driven, sliding security gate. Heretofore the only available method of securing locking gates of this type has been through the use of an electrical locking means, such as a solenoid type lock. Since the present invention is entirely mechanical, and is of a relatively simple and easy-to-construct design, it is substantially cheaper than electromagnetic solenoid-actuated locking systems. In addition, the system of the present invention requires very little maintenance, and is highly resistant to failure associated with repeated usage over a long period of time. The latching system of the present invention is thereby felt to have substantial advantages over previously known systems, and will afford a high degree of security at a low cost and virtually zero maintenance over a fairly long lifetime.

Although there have been described above specific arrangements of a drive-actuated latching device for a security parking gate in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A latching device for a security gate driven by a chain drive, comprising:

a housing fixedly connected to said security gate;

a control member movably mounted in said housing and extending outwardly therefrom, said control member having a first position and a second position, said control member being driven from said first position to said second position by said chain drive when said chain drive is actuated to open said security gate;

a lock member slidably mounted in said housing, said lock member having a locked position in which said lock member extends outwardly from said housing, and an unlocked position in which said lock member is drawn inwardly into said housing; and means for activating said lock member in response to said control member to cause said lock member to be driven from said locked position to said unlocked position when said control member moves from said first position to said second position.

2. A latching device as defined in claim 1, further comprising:

means mounted in a stationary position for receiving said lock member when said lock member is in said locked position and said security gate is closed, said receiving means preventing movement of said security gate when said lock member is engaged in said receiving means until such time as said lock member is driven to said unlocked position.

3. A latching device as defined in claim 2, further comprising:

means for retracting said lock member into said receiving means as said security gate moves from an open position into a closed position.

4. A latching device as defined in claim 3, wherein said retracting means comprises:

a ramp mounted on said receiving means to cause said lock member to retract into the housing as said security gate is closed, said lock member extending into said receiving member when said security gate reaches the fully closed position.

5. A latching device as defined in claim 2, further comprising:

means for preventing said security gate from being moved laterally, said preventing means preventing said lock member from being removed from engagement with said receiving means when said lock member is in said locked position and said gate is closed.

6. A latching device as defined in claim 5, wherein said preventing means comprises:

a pin attached to and extending outwardly from said housing;

a collar fixedly attached to the end of said pin extending outwardly from said housing; and fork means mounted on said receiving means for receiving said pin at a location on said pin between said housing and said collar, said fork means receiving said pin when said security gate is in a closed position.

7. A latching device as defined in claim 5, wherein said preventing means comprises:

a member affixed to the housing and having an operative portion aligned generally orthogonally to the lock member, the operative portion extending laterally beyond the housing to engage the stationary receiving means when the lock member is in the locked position and the security gate is closed; and means defining an opening in said receiving means for receiving the operative portion of said member and blocking lateral movement of the housing.

8. A latching device as defined in claim 7 wherein said member comprises an angled rod welded to the housing with the angled portion of the rod extending beyond the housing into alignment with said opening.

9. A latching device as defined in claim 1, wherein said actuating means comprises:

a flexible connector having a fixed length, said connector having a first end attached to said control member, and a second end attached to said lock member; and substantially circular rotational translation means about which a portion of said flexible connector is located, so that a movement by said control member in one direction at said first end produces a corresponding movement in a substantially orthogonal direction at said other end, causing movement of said lock member.

10. A latching device as defined in claim 9, wherein said flexible connector is a length of link-type chain.

11. A latching device as defined in claim 9, wherein said translation means is a length of pipe fixedly mounted in said housing at an angle substantially orthogonal to both said control member and said lock member.

12. A latching device as defined in claim 1, further comprising:

biasing means for urging said lock member toward said locked position, said biasing means also tending to urge said control member from said second position into said first position.

13. A latching device as defined in claim 12, wherein said biasing means comprises a spring.

14. A latching device as defined in claim 1, wherein one end of said control member is adapted to be attached to said chain drive at a location on said control member extending outwardly from said housing.

15. A latching device as defined in claim 1, wherein said housing is located to prevent access thereto from a location outside the area secured by said security gate.

16. A latching device as defined in claim 1, further including means for coupling said control member between opposite ends of said chain drive to:

(a) drive said gate to an open position after said lock member moves from said locked position to said unlocked position; and (b) drive said gate to a closed position.

17. A latching device for a security gate driven by a chain drive, comprising:

means for locking said gate in a closed position, said locking means including an extendible locking pin oriented generally orthogonally to the direction of movement of the security gate and the chain drive, the locking pin being extendible to a first locked position and retractable to a second unlocked position;

means coupled to said chain drive for withdrawing said locking pin from said first locked position to said second unlocked position in response to movement of said chain drive in a direction to open said gate and prior to movement of the gate.

18. A latching device as defined in claim 17, wherein said withdrawing means comprises:

a control member coupled to said chain drive, said control member being driven to an actuating position when said movement of said chain drive tending to open said gate is initiated; and mechanical translation means for driving said locking means to said unlocked position when said control member is driven to said actuating position.

19. A latching device for a mechanical drive security gate or the like, comprising:

a housing fixedly connected to said gate;

a control member mounted in said housing, said control member having a first position and a second position, said control member being driven to said second position when said mechanical drive operates to open said gate and coupled to drive said housing and gate between open and closed positions in response to said mechanical drive;

a lock member mounted in said housing orthogonally to said control member, said lock member having an extended locked position and a retracted unlocked position;

link means for connecting said control member to said lock member, said link means driving said lock member to said unlocked position when said control member moves from said first position to said second position in preparation for opening said gate;

means mounted in a stationary position for receiving said lock member when said lock member is in said locked position; and means for guiding said lock means into the receiving means to secure said gate when said gate is in a closed position.

20. A method for locking a chain drive security gate, comprising:

mounting a housing on said gate;

providing a slidable lock member in said housing in the form of a pin oriented generally orthogonally to the plane of the gate, said lock member having an extended locked position and a retracted unlocked position;

actuating said lock member to cause said lock member to be withdrawn to said unlocked position in mechanical response to initial movement of said chain drive to open said security gate; and driving said housing to open said gate upon further movement of the chain drive in the same direction.

21. A method as defined in claim 20, wherein said actuating step comprises:

providing a control member having a first position and a second position;

driving said control member to said second position when said chain drive is operated to open said security gate; and linking said lock member to said control member to cause said lock member to be driven from said locked position to said unlocked position when said control member is driven from said first position to said second position.

22. A method as defined in claim 20, additionally comprising:

biasing said lock member toward said locked position by providing a spring to urge said lock member into said locked position.

23. A method as defined in claim 20, additionally comprising:

providing a fixed member to receive said lock member to prevent movement of said security gate when said lock member is in said locked position.

24. A system for operating a security gate or the like, comprising:

a motorized drive unit having an output shaft containing a drive sprocket;

a slidable gate travelling on a track, one end of said track extending within a secured area, the other end of said track extending into an opening to said secured area;

an idler sprocket rotatably mounted within said secured area;

a housing mounted on the side of said gate nearer said one end of said track;

a control member slidably mounted in said housing and essentially parallel to said track, said control member having a first end extending from the side of said housing facing said one end of said track and a second end extending from the side of said housing facing said other end of said track, said control member moving to a first position when said first end is pulled, and to a second position when said second end is pulled;

a chain driven by said drive sprocket and extending over said idler sprocket, said chain having a first end link connected to said first end of said control member, and a second end link connected to said second end of said control member, said chain pulling said first end of said control member when said motorized drive unit is activated to open said gate, and said chain pulling said second end of said control member when said motorized drive unit is activated to close said gate; and a lock member slidably mounted in said housing orthogonal to said control member, said lock member being driven by said control member, said lock member extending from said housing when said control member is in said second position, said lock member withdrawing into said housing when said control member is in said first position.

25. A system as defined in claim 24 further comprising:

receiving means for receiving said lock member when said lock member is extended from said housing and said gate is closed, said receiving means being fixedly mounted.

26. A system as defined in claim 24 further comprising:

link means connecting said control member to said lock member, said link means driving said lock member inwardly into said housing when said control member moves from said second position into said first position.

27. A system as defined in claim 24 further comprising:

biasing means for maintaining said lock member in normal position extending outwardly from said housing.

* * * * *